US009052646B2

(12) United States Patent
Iida et al.

(10) Patent No.: US 9,052,646 B2
(45) Date of Patent: Jun. 9, 2015

(54) IMAGE FORMING APPARATUS WITH INTERMEDIARY TRANSFER BELT HAVING ION CONDUCTIVE AGENT

(71) Applicant: CANON KABUSHIKI KAISHA, Tokyo (JP)

(72) Inventors: Kenichi Iida, Tokyo (JP); Akimichi Suzuki, Yokohama (JP); Yusuke Shimizu, Yokohama (JP); Ryo Morihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/134,549

(22) Filed: Dec. 19, 2013

(65) Prior Publication Data

US 2014/0178111 A1 Jun. 26, 2014

(30) Foreign Application Priority Data

Dec. 20, 2012 (JP) ..... 2012-277967

(51) Int. Cl.
*G03G 15/01* (2006.01)
*G03G 15/16* (2006.01)

(52) U.S. Cl.
CPC ..... *G03G 15/162* (2013.01); *G03G 2215/0129* (2013.01)

(58) Field of Classification Search
CPC ..... G03G 15/1635; G03G 15/162; G03G 15/168; G03G 15/34; G01D 15/347
See application file for complete search history.

(56) References Cited

U.S. PATENT DOCUMENTS

| | | | | |
|---|---|---|---|---|
| 8,229,336 | B2 * | 7/2012 | Ono et al. | 399/302 |
| 8,340,558 | B2 | 12/2012 | Mori | |
| 2010/0021216 | A1 * | 1/2010 | Sawai | 399/302 |
| 2013/0259543 | A1 * | 10/2013 | Katagiri et al. | 399/302 |

FOREIGN PATENT DOCUMENTS

| | | | |
|---|---|---|---|
| JP | 2004117509 | A | 4/2004 |
| JP | 20100190965 | A | 9/2010 |
| JP | 2012128171 | A | 7/2012 |

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes an image bearing member, an intermediary transfer belt containing an ion conductive agent, a secondary transfer member, and a charging device. With respect to the intermediary transfer belt, when a difference in number of digits (or in log value) between resistivity measured by using a metal probe and resistivity measured by using a sputtering electrode is ΔM, a difference in number of digits (or in log value) between resistivity in a first environment and resistivity in a second environment higher than the first environment in temperature or humidity is ΔE, a length of the secondary transfer portion with respect to the movement direction of the intermediary transfer belt is La, and a distance from the charging portion to the primary transfer portion with respect to the movement direction is Lb, the following relationship is satisfied:

$$\Delta M \geq \Delta E - \log(Lb/La).$$

16 Claims, 14 Drawing Sheets

(a)

(b)

| | Log(ρ probe) | | Log(ρ sputter) | | ΔM | ΔE | Ra |
|---|---|---|---|---|---|---|---|
| | HH | LL | HH | LL | | | |
| ITB IN EMB. 1 | 10.00 | 12.48 | 8.02 | 10.51 | 1.98 | 2.49 | 10 |
| ITB IN COMP. A | 10.19 | 12.69 | 9.98 | 12.48 | 0.21 | 2.50 | 0.5 |
| ITB IN COMP. B | 9.52 | 12.01 | 9.32 | 11.78 | 0.22 | 2.49 | 0.5 |
| ITB IN COMP. C | 8.82 | 11.29 | 8.62 | 11.08 | 0.21 | 2.47 | 0.5 |

UNIT : nm

UNIT : Ω/SQ, Log VALUE

Fig. 9

| | |
|---|---|
| Log(ρ probe_limit) | 9.75 |
| Log(ρ sputter_limit) | 11.50 |
| ΔI | 1.75 |

UNIT : Ω/SQ, Log VALUE

Fig. 10

| | |
|---|---|
| Log( ρ probe_limit) | 9.75 |
| Log( ρ sputter_limit) | 12.13 |
| ΔI | 2.38 |

UNIT : Ω/SQ, Log VALUE

Fig. 16

IMAGE FORMING APPARATUS WITH INTERMEDIARY TRANSFER BELT HAVING ION CONDUCTIVE AGENT

FIELD OF THE INVENTION AND RELATED ART

This application claims priority from Japanese Patent Application No. 277967/2012 filed Dec. 20, 2012, which is hereby incorporated by reference herein.

The present invention relates to an image forming apparatus for forming a recording image on a transfer(-receiving) material.

An image forming apparatus of a type using an intermediary transfer member has been conventionally known as, e.g., an electrophotographic image forming apparatus such as a copying machine or a laser beam printer. The image forming apparatus of the intermediary transfer type forms a color image on a temperature through a primary transfer step and a secondary transfer step. That is, a toner image formed on an image bearing member is primary-transferred onto the intermediary transfer member and thereafter is secondary-transferred onto the temperature, so that an image is formed on the temperature.

The intermediary transfer member is formed of an electroconductive resin composition or the like having a predetermined electric resistance, and when the resistance is excessively small, leakage of a transfer current to a non-image portion is generated, so that a problem such as improper transfer is generated. On the other hand, when the resistance exceeds a predetermined value, a potential memory due to the transfer current or a cleaning current is generated, so that a problem of roughness (graininess) or vertical stripes is generated. As countermeasures against these problems, as described in Japanese Laid-Open Patent Application (JP-A) 2004-117509, it would be considered that electroconductivity is imparted to a material constituting the intermediary transfer member. As a method therefor, there is a method of adding an electroconductive agent, such as carbon black, having electronic electroconductivity into a material. However, in the method in which the electronic electroconductivity is imparted, a resistance value is liable to be changed due to variation or the like in dispersion condition or mixing amount of the electronic electroconductivity, so that it is difficult to obtain a predetermined electric resistance. Further, also a degree of dependency of the electric resistance on an applied voltage becomes large, in some cases, it becomes difficult to stably control the transfer current during an image forming operation.

On the other hand, there is a method of adding an electroconductive agent having an ion conductivity (ionic electroconductivity) into a material constituting the intermediary transfer member. By using this method, the above problems can be solved. However, with respect to the intermediary transfer member, a fluctuation in resistance value due to a change in environment is large, so that it is difficult to compatibly suppress the problems such as the improper transfer, the graininess, the vertical stripes and the like, irrespective of the environment.

SUMMARY OF THE INVENTION

A principal object of the present invention is to provide an image forming apparatus capable of further suppressing image defects in the case where an intermediary transfer member contains an electroconductive agent (material) having ion conductivity (ionic electroconductivity).

According to an aspect of the present invention, there is provided an image forming apparatus comprising: an image bearing member for bearing a toner image; a rotationally movable intermediary transfer belt onto which the toner image is to be primary-transferred from the image bearing member at a primary transfer portion where the intermediary transfer belt contacts the image bearing member, wherein the intermediary transfer belt has electroconductivity by containing an ion conductive agent; a secondary transfer member for secondary-transferring the toner image from the intermediary transfer belt onto a transfer material at a secondary transfer portion where the intermediary transfer belt contacts the transfer material; and a charging device for electrically charging the intermediary transfer belt or a toner on the intermediary transfer belt at a charging portion positioned downstream of the secondary transfer portion and upstream of the primary transfer portion with respect to a movement direction of the intermediary transfer member, wherein when a difference in number of digits between resistivity of the intermediary transfer belt measured by using a metal probe and resistivity of the intermediary transfer belt measured by using a sputtering electrode is ΔM, a difference in number of digits between resistivity of the intermediary transfer belt in a first environment and resistivity of the intermediary transfer belt in a second environment higher than the first environment in temperature or humidity is ΔE, a length of the secondary transfer portion with respect to the movement direction of the intermediary transfer belt is La, and a distance from the charging portion to the primary transfer portion with respect to the movement direction is Lb, the following relationship is satisfied:

$$\Delta M \geq \Delta E - \log(Lb/La).$$

According to another aspect of the present invention, there is provided an image forming apparatus comprising: an image bearing member for bearing a toner image; a rotationally movable intermediary transfer belt onto which the toner image is to be primary-transferred from the image bearing member at a primary transfer portion where the intermediary transfer belt contacts the image bearing member, wherein the intermediary transfer belt has electroconductivity by containing an ion conductive agent; a secondary transfer member for secondary-transferring the toner image from the intermediary transfer belt onto a transfer material at a secondary transfer portion where the intermediary transfer belt contacts the transfer material, wherein when a difference in number of digits between resistivity of the intermediary transfer belt measured by using a metal probe and resistivity of the intermediary transfer belt measured by using a sputtering electrode is ΔM, a difference in number of digits between resistivity of the intermediary transfer belt in a first environment and resistivity of the intermediary transfer belt in a second environment higher than the first environment in temperature or humidity is ΔE, a length of the secondary transfer portion with respect to the movement direction of the intermediary transfer belt is La, and a distance from the secondary transfer portion to the primary transfer portion with respect to the movement direction is Lc, the following relationship is satisfied:

$$\Delta M \geq \Delta E - \log(Lc/La).$$

These and other objects, features and advantages of the present invention will become more apparent upon a consideration of the following description of the preferred embodiments of the present invention taken in conjunction with the accompanying drawings.

Figure 2:
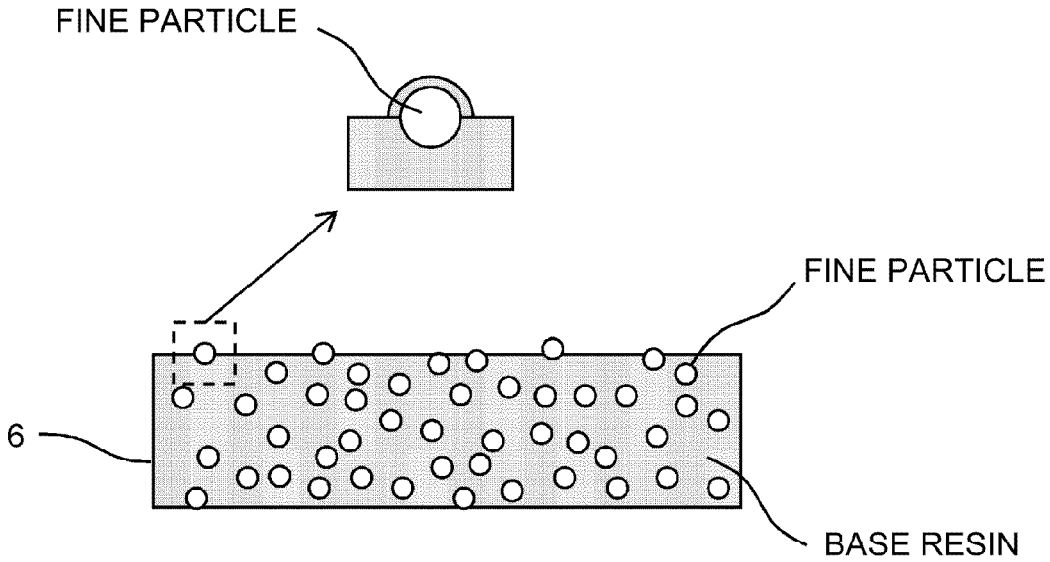
Figure 2:
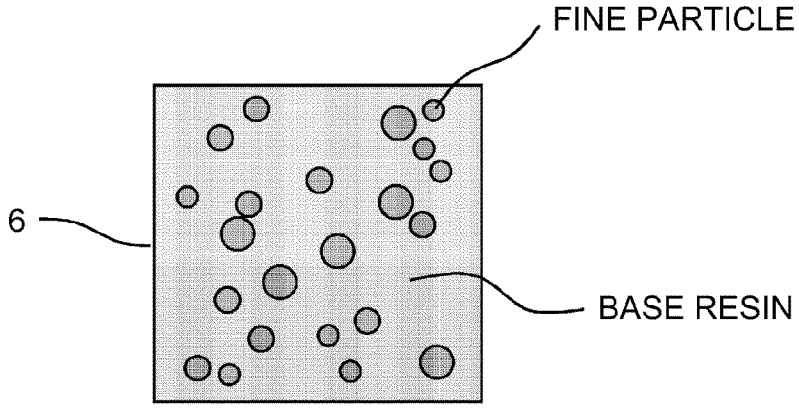

Parts (a) and (b) of FIG. 2 are schematic views showing a structure of an intermediary transfer belt in Embodiment 1.

Figure 3:
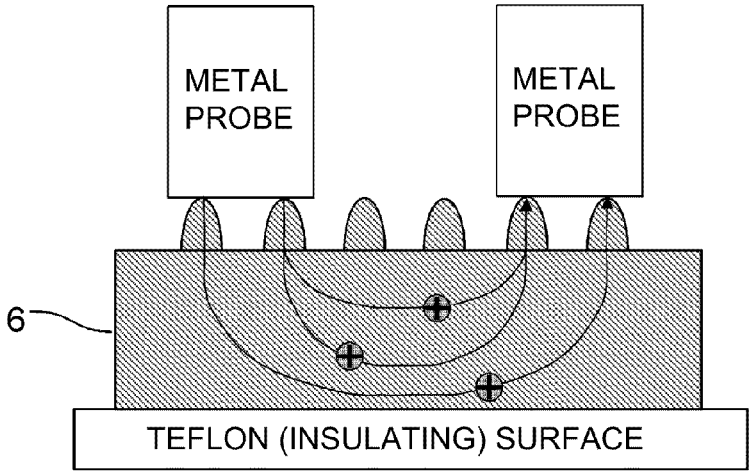

FIG. 3 is a schematic view for illustrating a measuring method of a resistivity of the intermediary transfer belt by a metal probe.

Figure 4:
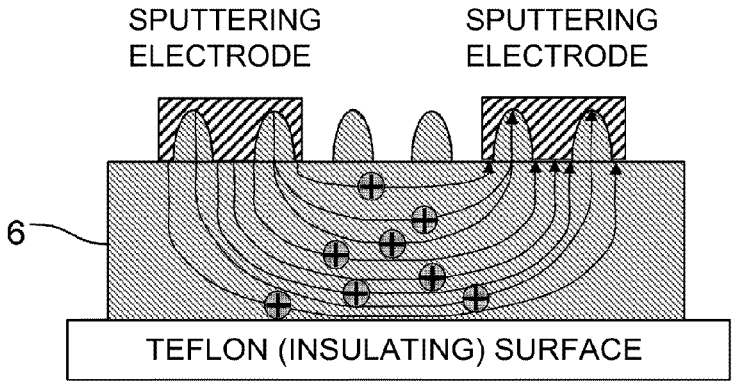

FIG. 4 is a schematic view for illustrating a measuring method of a resistivity of the intermediary transfer belt by a sputtering electrode.

Figure 5:
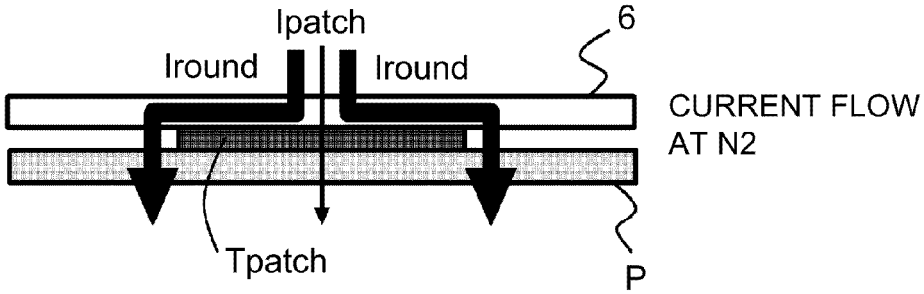

FIG. 5 is a schematic view for illustrating a state in which improper transfer of a patch-like image is generated.

Figure 6:
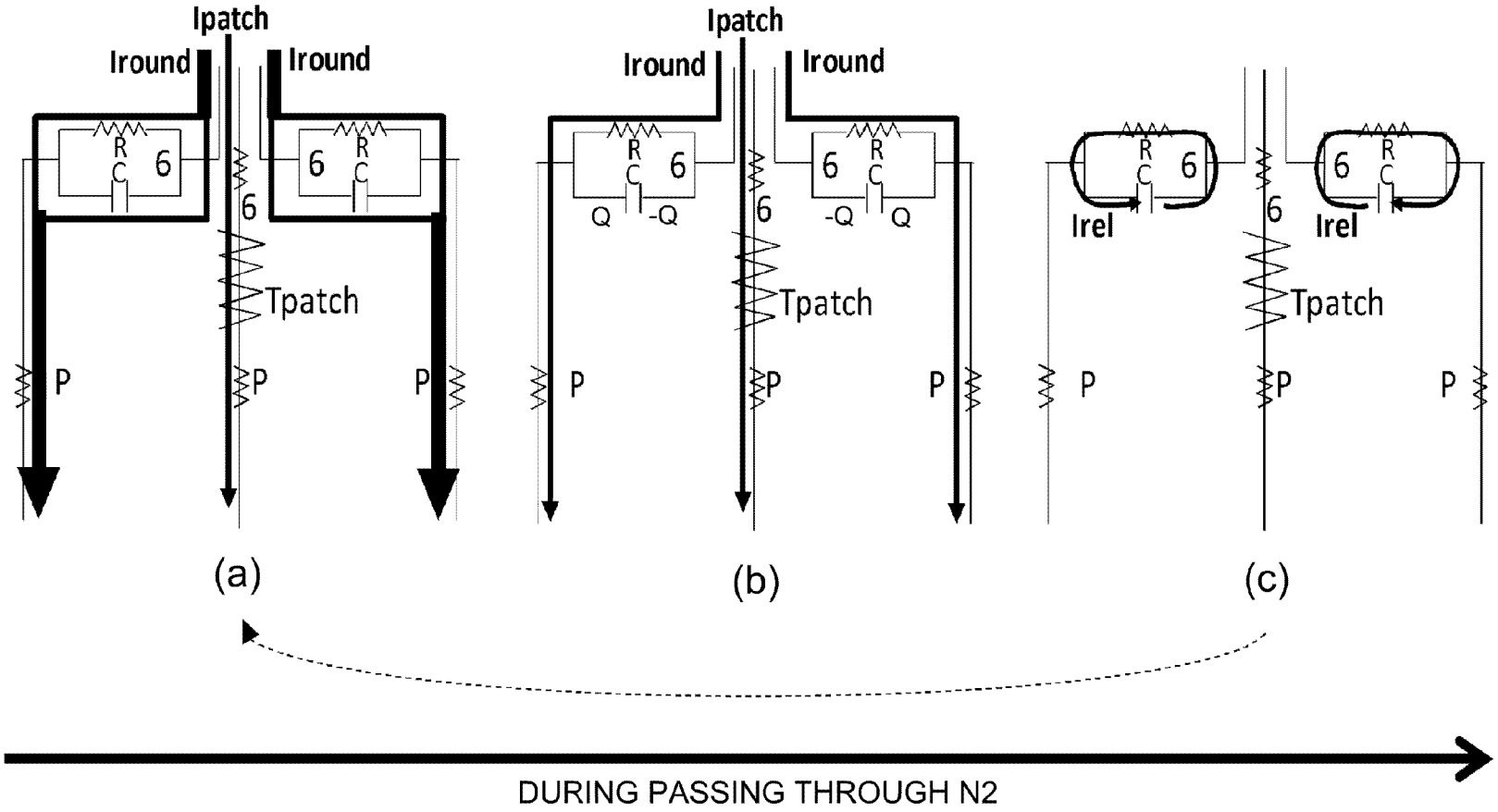

Parts (a), (b) and (c) of FIG. 6 are schematic model views for illustrating a state in which a rounding current is changed.

Figure 7:
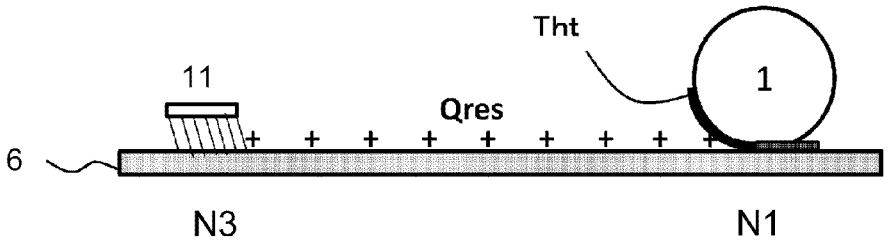

FIG. 7 is a schematic view showing a state in which a vertical stripe of a halftone image is generated.

Figure 8:
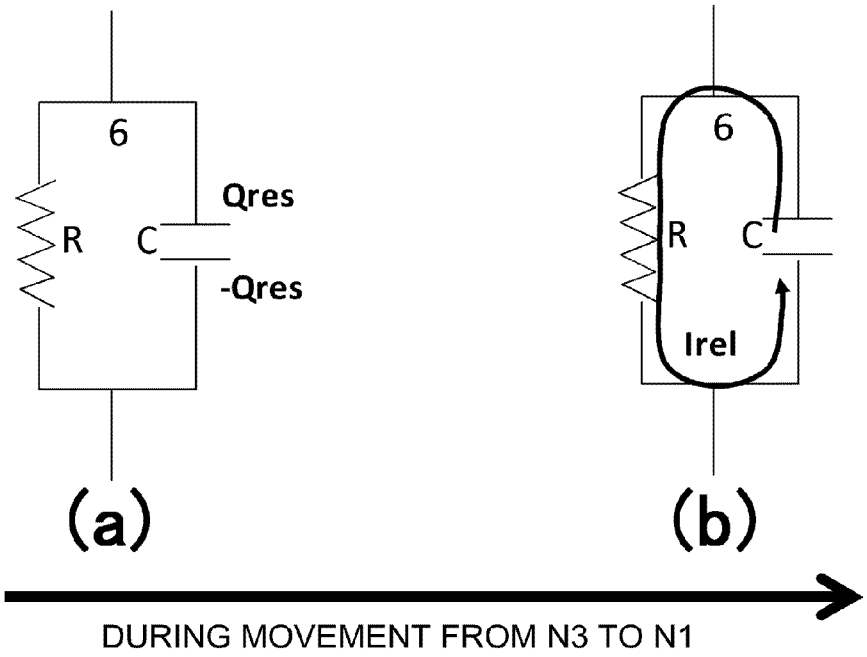

Parts (a) and (b) of FIG. 8 are schematic model views for illustrating a state in which a residual electric charge is attenuated.

FIG. 9 is a table showing values of resistivity and roughness of the intermediary transfer belt.

FIG. 10 is a table showing values of resistivities at which improper transfer and a vertical stripe are generated.

Figure 11:
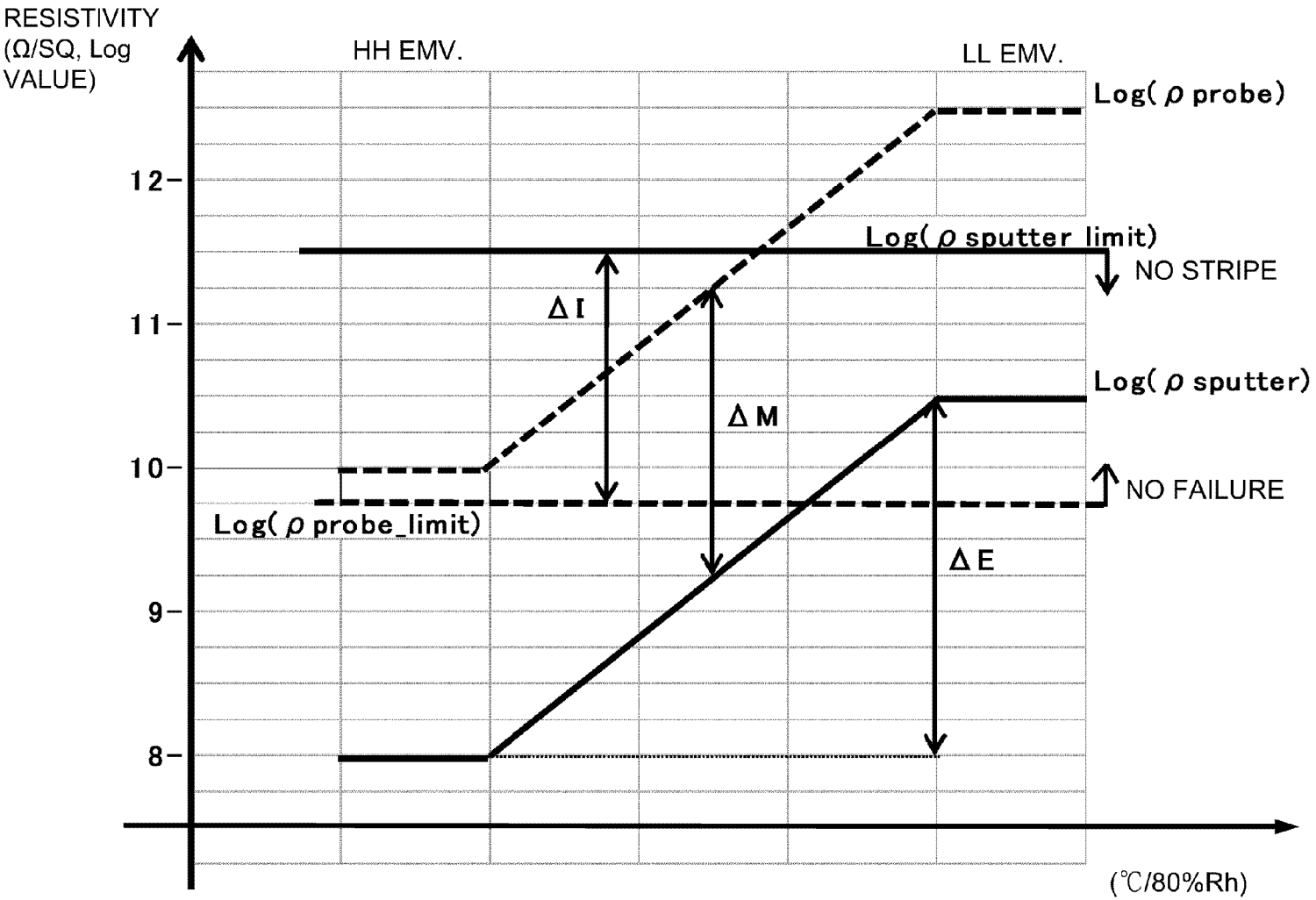

FIG. 11 is a graph for illustrating resistivities of the intermediary transfer belt in Embodiment 1.

Figure 12:
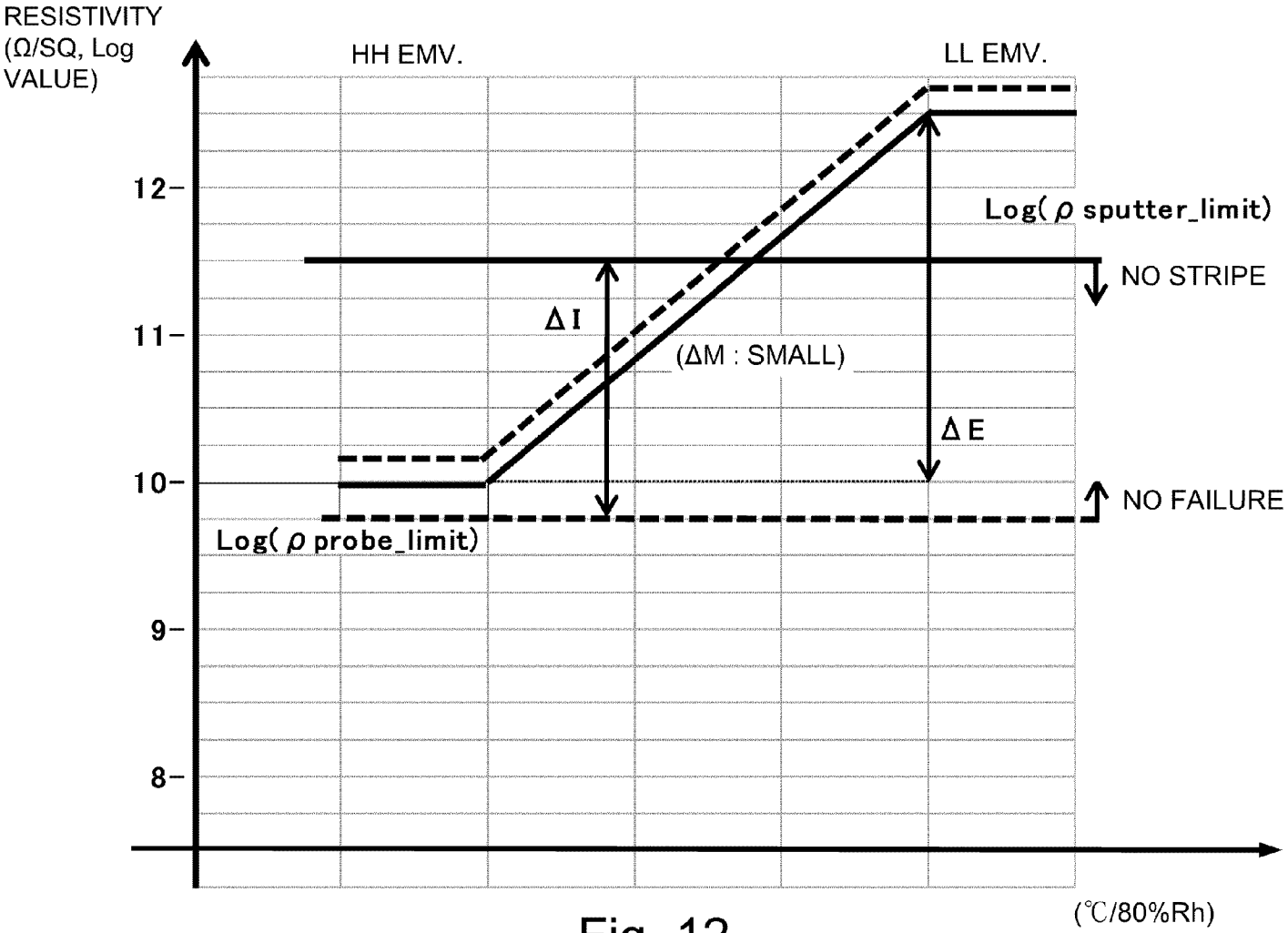

FIG. 12 is a graph for illustrating resistivities of an intermediary transfer belt in Comparison constituent A.

Figure 13:
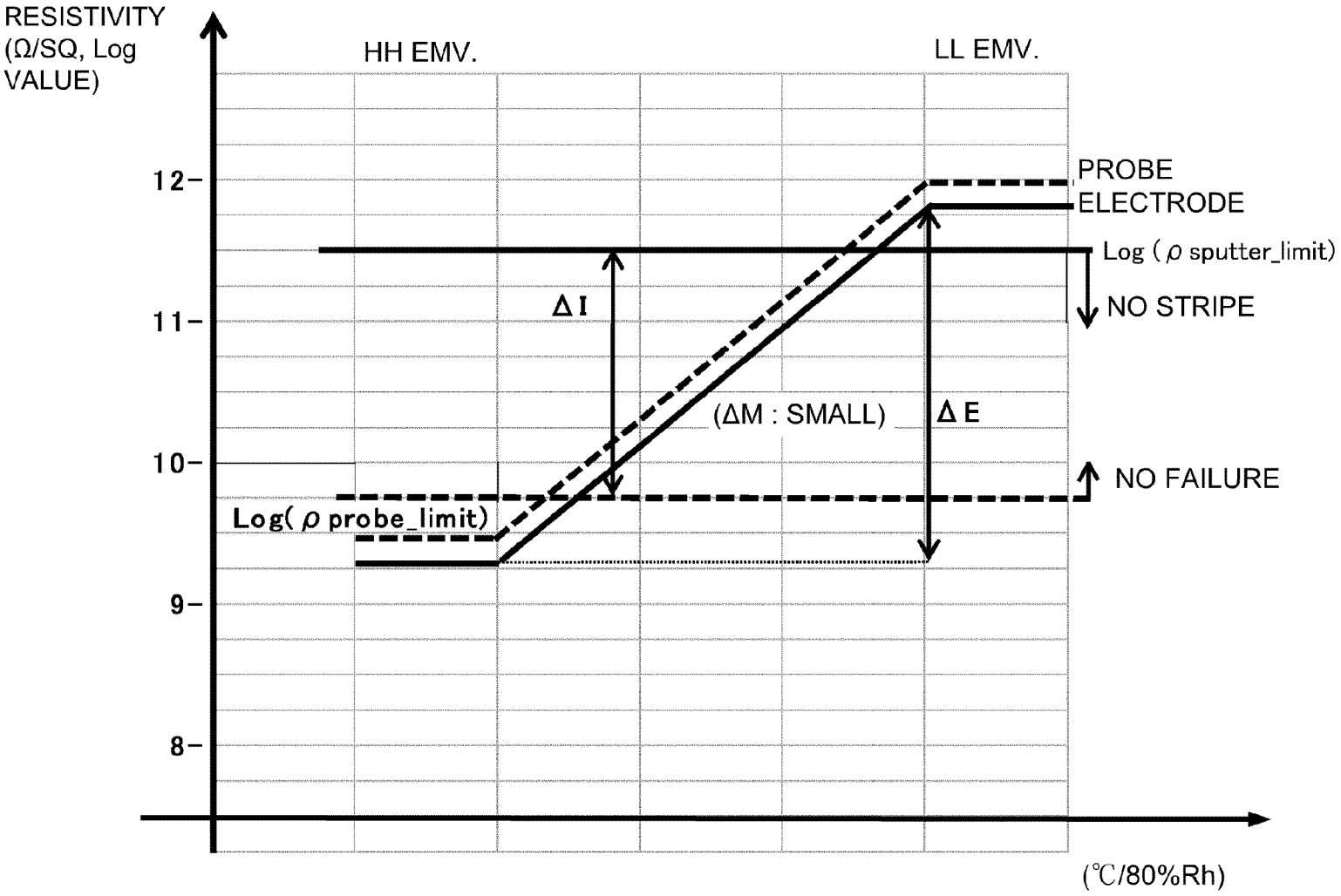

FIG. 13 is a graph for illustrating resistivities of an intermediary transfer belt in Comparison constituent B.

Figure 14:
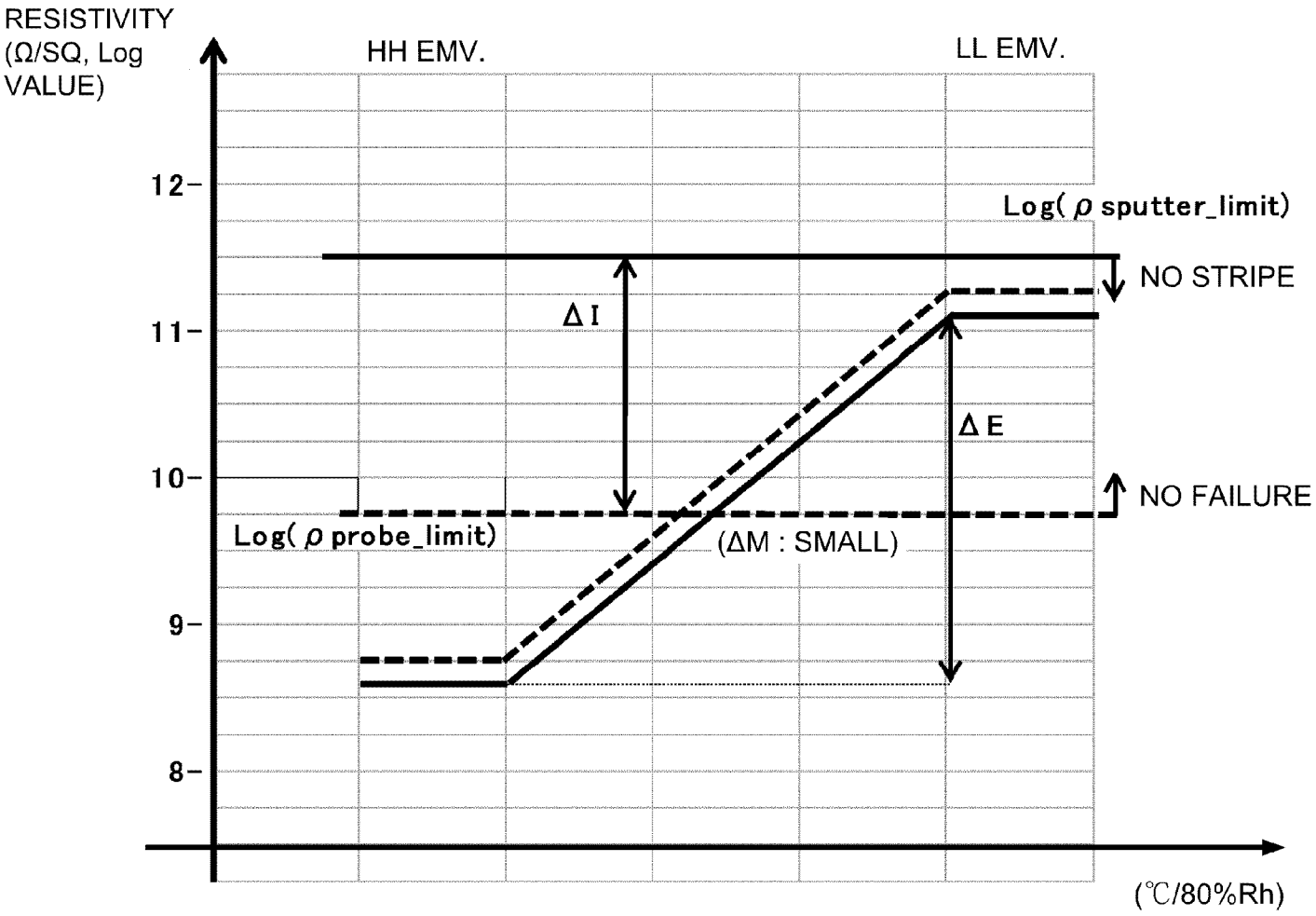

FIG. 14 is a graph for illustrating resistivities of an intermediary transfer belt in Comparison constituent C.

Figure 15:
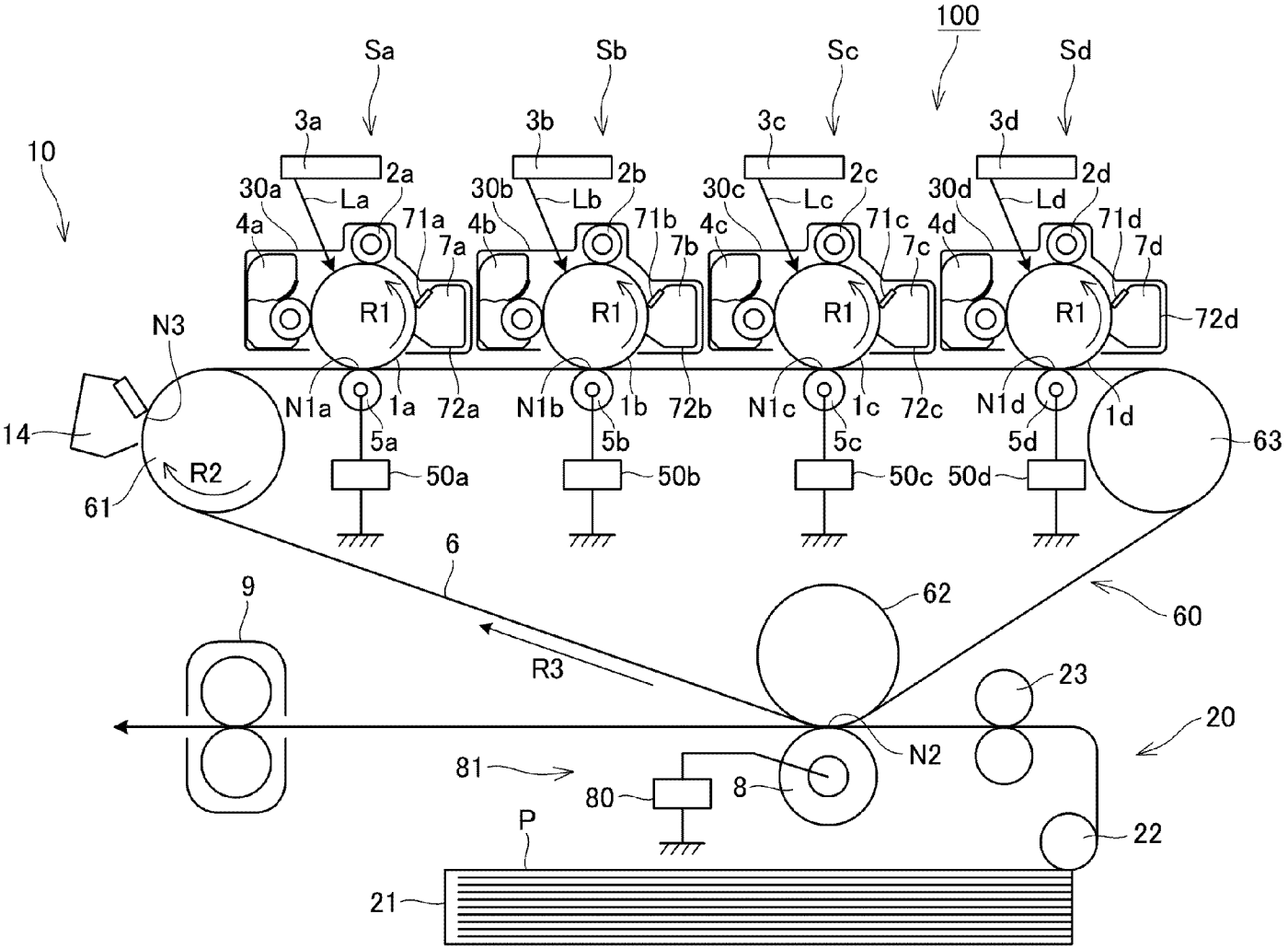

FIG. 15 is a schematic sectional illustration of an image forming apparatus in Embodiment 2 of the present invention.

FIG. 16 is a table showing values of resistivities at which improper transfer and graininess are generated.

Figure 17:
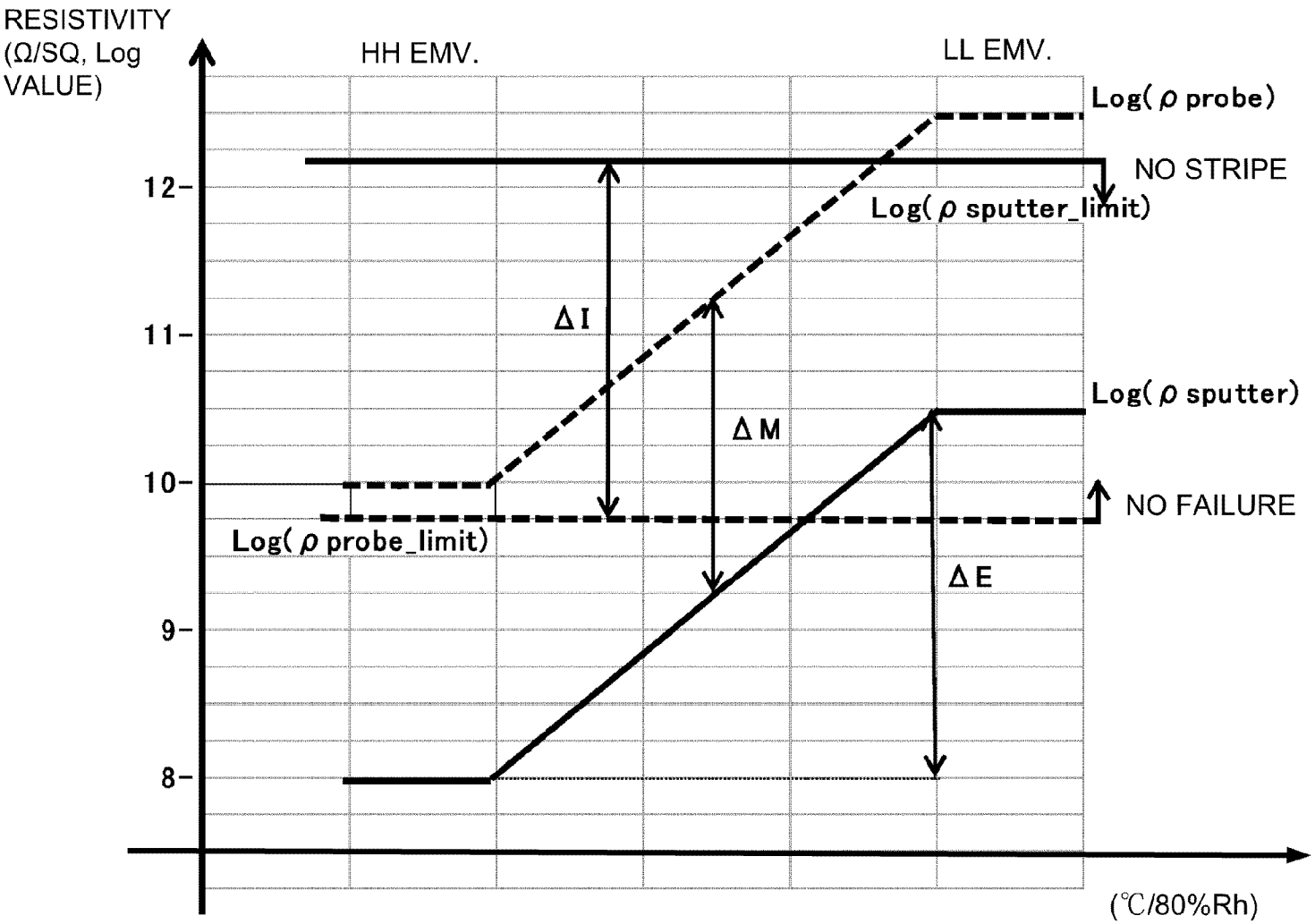

FIG. 17 is a graph for illustrating resistivities of an intermediary transfer belt in Embodiment 2.

Figure 18:
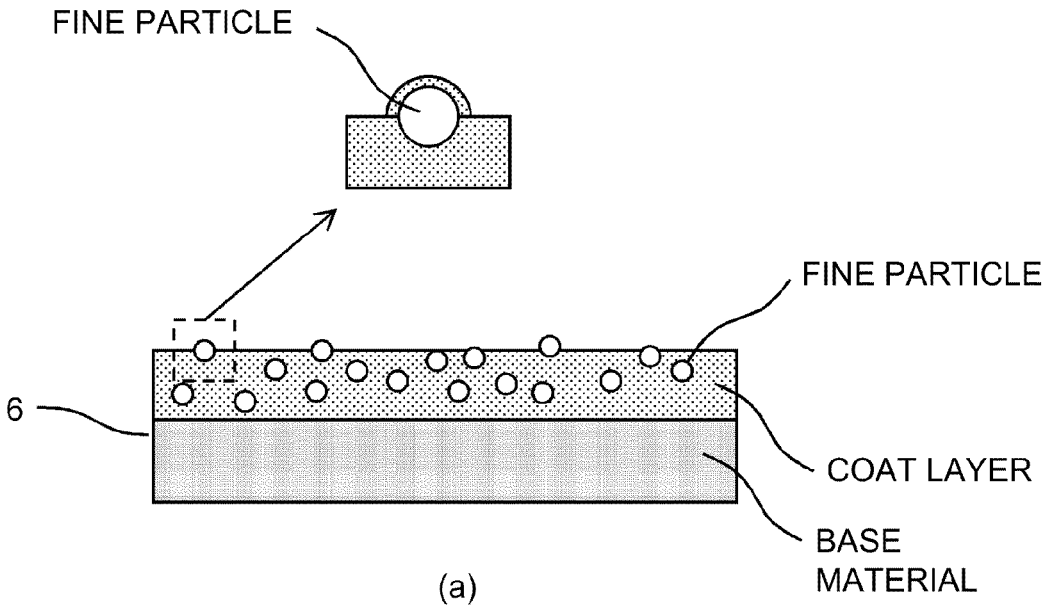
Figure 18:
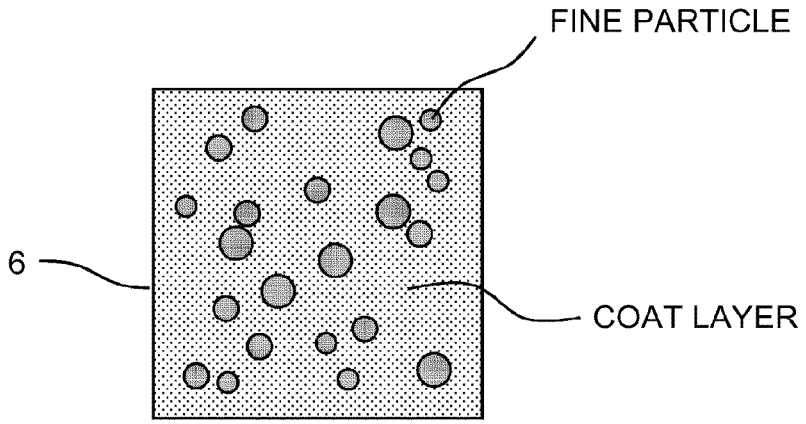

Parts (a) and (b) of FIG. 18 are schematic views showing another structure of the intermediary transfer belt in the present invention.

DESCRIPTION OF THE PREFERRED EMBODIMENTS

With reference to the drawings, embodiments for carrying out the present invention will be exemplarily described specifically below. However, dimensions, materials, shapes and relative arrangements of constituent elements described in the following embodiments should be appropriately modified depending on constitutions and various conditions of an apparatus to which the present invention is applied. That is, the scope of the present invention is not intended to be limited to the following embodiments.

Embodiment 1

1. General Structure of Image Forming Apparatus

Figure 1:
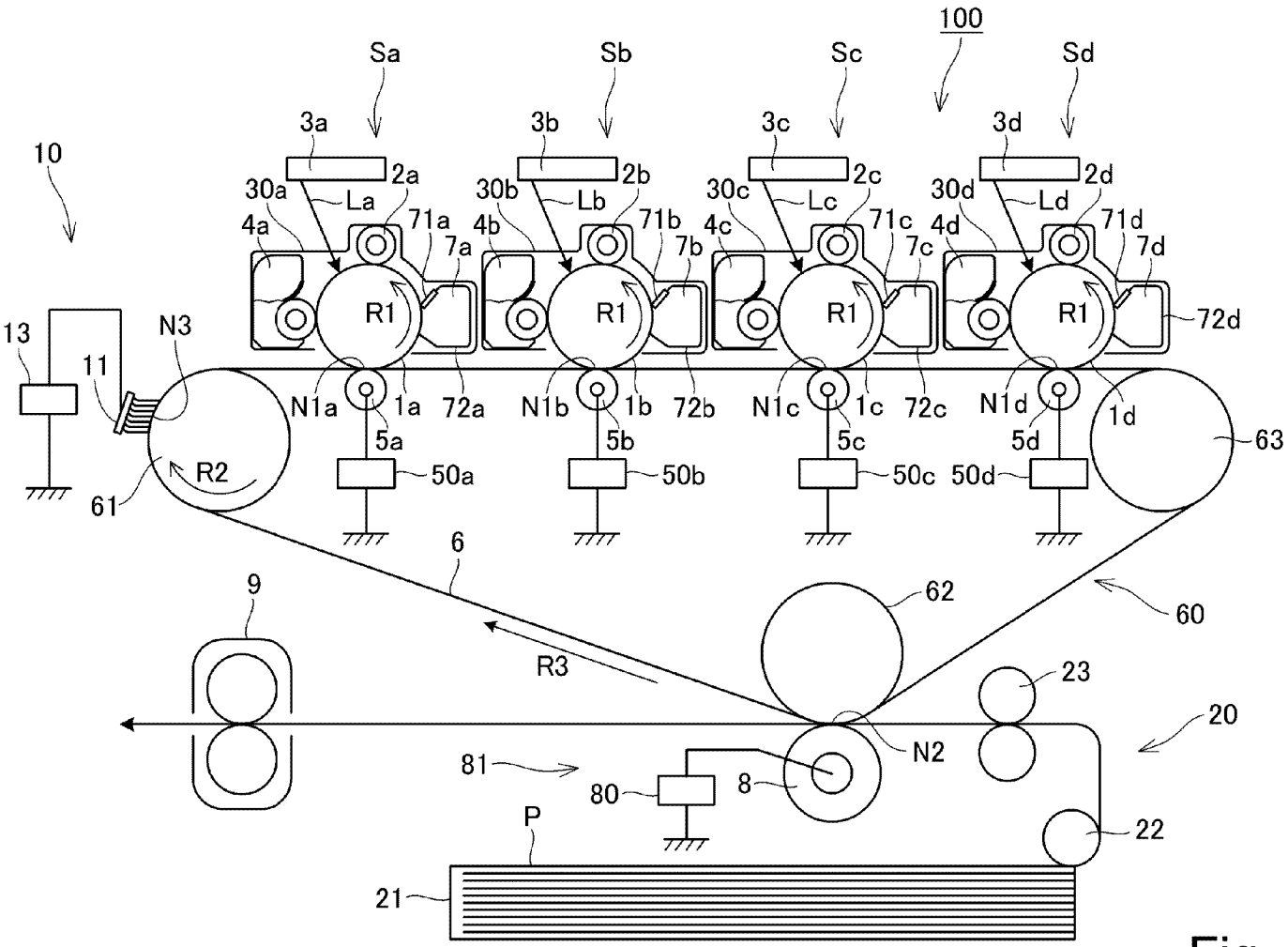
FIG. 1 is a schematic sectional illustration of an image forming apparatus in Embodiment 1 of the present invention.

FIG. 1 is a schematic sectional view showing a general structure of an image forming apparatus 100 according to this embodiment of the present invention. The image forming apparatus 100 in this embodiment is a full-color laser beam printer of an electrophotographic type. Further, the image forming apparatus 100 employs an intermediary transfer member and is of a tandem type in which a plurality of photosensitive members (image bearing members) are provided and disposed in a line for speed-up. That is, in the image forming apparatus 100, toner images of a plurality of colors each formed on the associated image bearing member in accordance with image information separated into a plurality of color components are successively primary-transferred superposedly onto an intermediary transfer member and thereafter are collectively secondary-transferred onto a temperature (recording material) to obtain a recording image.

The image forming apparatus 100 includes, as a plurality of image forming portions, first to fourth stations Sa, Sb, Sc and Sd. In this embodiment, the first to fourth stations Sa, Sb, Sc and Sd are used for forming toner images of yellow (Y), magenta (M), cyan (C) and black (K), respectively. In many cases, constitutions and operations are common to the respective stations Sa to Sd. Accordingly, in the following, in the case where there is no need to particularly distinguish the stations, description will be made by omitting suffixes, a, b, c and d for representing elements provided for associated colors.

The image forming apparatus 100 includes a photosensitive drum 1 as an image bearing member in the station S. The photosensitive drum 1 is rotationally driven in an arrow R1 direction (counterclockwise direction), indicated in FIG. 1, by a driving unit (not shown). A surface of the photosensitive drum 1 is electrically charged uniformly by a charging roller 2. Then, the surface of the photosensitive drum 1 is irradiated with laser light L, in accordance with the image information, emitted from an exposure unit 3, so that an electrostatic latent image is formed. When the surface of the photosensitive drum 1 further moves in the arrow R1 direction, the latent image formed on the surface of the photosensitive drum 1 in accordance with the image information is visualized as a toner image by a developing device 4. The developing device 4 develops the latent image on the drum 1 by a reversal development method. That is, the developing device 4 develops the latent image by depositing, on an image portion (exposed portion) on the uniformly charged photosensitive drum 1, a toner charged to the same polarity (negative) as a charge polarity (negative in this embodiment) of the photosensitive drum 1. In this embodiment, a normal charge polarity of the toner is negative.

With respect to a movement direction of the surface of the photosensitive drum 1 shown by the arrow R1 in FIG. 1, an intermediary transfer belt 6 as the intermediary transfer member is provided downstream of a developing position. The intermediary transfer belt 6 is provided in an intermediary transfer unit 60 and is a cylindrical and endless belt-like film stretched by three rollers consisting of a driving roller 61, a secondary transfer opposite roller 62 and a tension roller 63. The intermediary transfer belt 6 is moved (rotated) in an arrow R3 direction (clockwise direction) substantially at the same speed as a surface movement speed of the photosensitive drum 1 by rotationally driving the driving roller 61 in an arrow R2 direction (clockwise direction).

In a position opposing the photosensitive drum 1 via the intermediary transfer belt 6, a primary transfer roller 5 (primary transfer member) is provided. The primary transfer roller 5 urges the intermediary transfer belt 6 toward the photosensitive drum 1 to form a primary transfer nip N1 where the photosensitive drum 1 and the intermediary transfer belt 6 are in contact with each other. The toner image formed on the photosensitive drum 1 with rotation of the photosensitive drum 1 and the intermediary transfer belt 6 is primary-transferred onto an outer peripheral surface of the intermediary transfer belt 6 by the action of the primary transfer roller 5. At this time, to the primary transfer roller 5, a primary transfer voltage of a positive polarity is applied from a primary transfer power source 50.

In a primary transfer step, a transfer residual toner remaining on the photosensitive drum 1 without being transferred onto the intermediary transfer belt 6 is removed by a photosensitive drum cleaner 7 that includes a cleaning blade 71 as a plate-like elastic member contacted to the surface of the photosensitive drum 1. Further, the photosensitive drum cleaner 7 includes a toner container 72 for collecting the toner removed from the surface of the photosensitive drum 1 by the cleaning blade 71.

The above-described steps of charging, exposure, development and primary transfer are successively performed from an upstream side of the movement direction of the surface of the intermediary transfer belt 6 in the order of the first to fourth stations Sa, Sb, Sc and Sd for yellow, magenta, cyan and black, respectively. As a result, on the intermediary transfer belt 6, a full-color toner image obtained by superposed four color toner images of yellow, magenta, cyan and black is formed.

In a position opposing the secondary transfer opposite roller 62 via the intermediary transfer belt 6, a secondary transfer roller 8 (secondary transfer member) is provided. The secondary transfer roller 8 is urged against the intermediary transfer belt 6 toward the secondary transfer opposite roller 62 to form a secondary transfer nip N2 where the intermediary transfer belt 6 and the secondary transfer roller 8 are in contact with each other. The toner image on the intermediary transfer belt 6 is secondary-transferred onto the recording medium P by the action of the secondary transfer roller 8. That is, at a medium feeding portion 20, the medium P accommodated in a cassette 21 is fed by a feeding roller 22 and thereafter is supplied, at predetermined timing by a registration roller pair 23, to the secondary transfer nip N2 where the intermediary transfer belt 6 and the secondary transfer roller 8 are in contact with each other. Substantially at the same time, to the secondary transfer roller 8, a secondary transfer voltage of a positive polarity is applied from a secondary transfer power source 80. The medium P which is nip-conveyed through the secondary transfer nip N2 and on which the toner image is transferred from the intermediary transfer belt 6 is then conveyed to a fixing device 9. In the fixing device 9, the toner image is heated and pressed to be fixed on the medium P.

In a position opposing the driving roller 61 via the intermediary transfer belt 6, a cleaning brush 11 (toner charging device) is provided. In the cleaning unit 10, the cleaning brush 11 contacts the intermediary transfer belt 6 to form a cleaning nip N3 as a contact portion. In the secondary transfer step, a transfer residual toner remaining on the intermediary transfer belt 6 without being transferred onto the medium P is supplied with positive electric charges by the cleaning brush 11 through aerial discharge. To the cleaning brush 11, a cleaning voltage of the positive polarity (opposite to the normal charge polarity of the toner) is applied from a cleaning power source 13. Then, the transfer residual toner supplied with positive electric charges is reversely transferred onto the photosensitive drum 1*a* at the primary transferring nip N1 at the same time with the primary transfer step of a subsequent page (temperature) at timing of sheet interval or after completion of image formation (post-rotation). Further, the transfer residual toner deposited on the photosensitive drum 1*a* by being reversely transferred from the intermediary transfer belt 6 is removed from the surface of the photosensitive drum 1*a* by the cleaner 7*a* to be collected in the cleaner 7*a*.

2. Primary Transfer Roller

As the primary transfer roller 5, it is possible to use an elastic roller of $10^4$-$10^6$ (Ω·cm) in volume resistivity and 30 (degrees) in rubber hardness (measured by an Asker C hardness meter). The primary transfer roller 5 is urged against the photosensitive drum 1 via the intermediary transfer belt 6 at a total pressure of about 9.8 (N). Further, to the primary transfer roller 5, from the primary transfer power source 50, the primary transfer voltage of 0-1.0 (KV) is applicable. During normal printing, 500 (V) is applied.

3. Secondary Transfer Roller

As the secondary transfer roller 8, a roller which is a foamed elastic member having a surface cell structure and which is $10^7$-$10^9$ (Ωcm) and 60 (degrees) in hardness can be used. The secondary transfer roller 8 is urged against the secondary transfer opposite roller 62 via the intermediary transfer belt 6 at a total pressure of about 39.2 (N). Further, the secondary transfer roller 8 is rotated by the rotation of the intermediary transfer belt 6. To the secondary transfer 8, from the secondary transfer power source 80, the secondary transfer voltage of 0-4.0 (kV) is applicable. This power source includes a current detecting circuit and is capable of executing constant-current control using a desired current as a target current by a DC controller (not shown) of the image forming apparatus. During the printing, the constant-current control is effected with the current of 25 μA as the target current.

4. Cleaning Brush

As the cleaning brush 11, it is possible to use a brush in which nylon fibers of $10^6$-$10^{10}$ (Ωcm) in volume resistivity (electroconductivity) are arranged in a dense manner. The fibers can have single yarn fineness of 5 (dtex), single yarn length of 5 (mm) and arrangement density of 65 (F/$m^2$). In this embodiment, the cleaning brush 11 is fixedly disposed and is set so that an end of the cleaning brush 11 has a penetration amount of 1.0 (mm) into the surface of the intermediary transfer belt 6. The cleaning brush 11 is contacted to the intermediary transfer belt 6 toward the driving roller 61. The cleaning brush 11 rubs the surface of the intermediary transfer belt 6 with the rotation of the intermediary transfer belt 6. Further, to the cleaning brush 11, from the cleaning power source 13, the cleaning voltage of 0 to +2.0 (kV) is applicable. Also this power source includes the current detecting circuit and is capable of executing the constant-current control using a desired current as a target current by the DC controller (not shown) of the image forming apparatus. During the printing, the constant-current control is effected with the current of 35 (μA) as the target current.

5. Intermediary Transfer Belt

The intermediary transfer belt 6 is stretched by three shafts of the driving roller 61, the secondary transfer opposite roller 62 and the tension roller 63, and is supplied with tension of about 20 (N) in total pressure by the tension roller 63. The intermediary transfer belt 6 may have a thickness of 40-150 (μm). In this embodiment, the thickness of the intermediary transfer belt 6 is 65 (μm).

The intermediary transfer belt 6 can be constituted by a material containing an ion conductive agent (ionic electroconductive agent) and fine particles for controlling a belt surface shape.

As a base resin material, it is possible to use thermoplastic resin materials such as polycarbonate, polyvinylidene fluoride (PVDF), polyethylene, polypropylene, polymethylpentene-1, polystyrene, polyamide, polysulfone, polyalylate, polyethylene terephthalate, polybutylene terephthalate, polyethylene naphthalate, polybutylene naphthalate, polyphenylene sulfide, polyether sulfide, polyether nitrile, thermoplastic polyamide, polyether ether ketone, thermotropic liquid crystal polymer, and polyamide acid. These materials can also be in mixture of two or more species.

As the ion conductive agent, it is possible to use polyvalent metal salts, quaternary ammonium salts, and the like. The quaternary ammonium salt may contain a cationic component, such as tetraethylammonium ion, tetrapropylammonium ion, tetraisopropylammonium ion, tetrabutylammonium ion, tetrapentylammonium ion, or tetrahexylammonium ion, and an anionic component, such as halogen ion, fluoroalkyl sulfate ion having 1-10 carbon atoms, fluoroalkyl sulfite ion or fluoroalkyl borate ion. Further, it is also possible to employ a constitution in which polyether ester amide resin is principally used and sodium perfluorobutane sulfonate is added to the resin.

The fine particles may be inorganic particles and organic particles. Examples of the inorganic particles may include particles of glass sphere, cryolite, zinc oxide, titanium oxide, calcium carbonate, clay, talc, silica, wollassstonite, zeolite, hydrogen fluoride, diatomite, silica sand, pumice powder, slate powder, alumina, alumina white, aluminum sulfate, barium sulfate, lithopone, calcium sulfate, molybdenum disulfide, or the like. Examples of the organic particles may include particles of melamine resin, polytetrafluoroethylene (PTFE), polychlorotrifluoroethylene resin, tetrafluoroethylene-hexafluoropropylene resin, vinylfluoride resin, vinylidenefluoride resin, dichlorodifluoroethylene resin, a copolymer of these resins, silicone-based compound or rubber such as silicone resin powder or silicone rubber, or the like. From these materials, one or more species can be appropriately selected. As a particle size, an average particle size of 5 (nm) to 300 (nm) may preferably be selected.

The particle size of the fine particles may be measured by taking an electron micrograph of the particles through a scanning electron microscope. Specifically, 50 fine particles are randomly selected, and a short diameter and a long diameter of each of the particles are measured to calculate values of ((short diameter)+(long diameter))/2. A value of arithmetic mean of these values can be used as the particle size.

The above-described ingredients are melt-kneaded and are then subjected to molding appropriately selected from inflation molding, cylindrical extrusion molding and injection stretch blow molding, thus obtaining the intermediary transfer belt 6 as a resin composition.

A structure of the thus-obtained intermediary transfer belt 6 is schematically shown in FIG. 2. Part (a) of FIG. 2 is a schematic sectional view of the intermediary transfer belt 6, and (b) of FIG. 2 is a schematic front view of the intermediary transfer belt 6. As shown in these figures, the added fine particles are disposed in the material, so that a minute unevenness is formed on the surface of the intermediary transfer belt 6. The fine particles are dispersed in a primary particle state or in a secondary state or a third particle state by agglomeration in some cases. Further, the fine particles are not present on the belt surface in a completely exposed state but are buried, as the resin composition, in the belt. Further, the fine particles are coated with the belt material.

6. Measurement of Physical Properties of Intermediary Transfer Belt

Methods of measuring various physical properties of the intermediary transfer belt 6 follow.

<Surface Roughness>

The surface roughness is measured by using a scanning probe microscope ("SPI3800", manufactured by SII Nano Technology Inc.). A cantilever is formed of silicone, and is 15 (nm) or less in end diameter, 15 (N/m) in spring constant and 136 (kHz) in resonance frequency. As a measuring mode, a dynamic force mode in which a high-accuracy image on the order of nm can be obtained without breaking a sample is used. A measurement frequency is 0.3-1.0 (Hz). An observation field of view is 6 (μm) square, and is scanned with a stylus of a measuring device to obtain an average of values at non-overlapping 10 points, so that an average in-plane roughness Ra (nm) of the surface of the intermediary transfer belt 6 can be determined.

The resistivities (surface resistivities) of the intermediary transfer belt 6 are measured by the following methods of two types.

<Resistivity Measured by Metal Probe)

A high-resistance resistance meter ("Hiresta-UP (MCP-HT 450)", manufactured by Mitsubishi Chemical Corp.) is used for measurement. As a measuring probe, a metal probe ("UR100 probe (MCP-HTP16)", manufactured by Mitsubishi Chemical Corp.) is used and pressed against the surface of the intermediary transfer belt 6, and as an opposite plate, a TEFLON surface (insulating surface) of a ("Resitable UFL (MCP-STO3)", manufactured by Mitsubishi Chemical Corp.) is used. Under a condition of 250 (V) in applied voltage, 10 (sec) in measurement time and a surface resistance measuring mode, a resistivity ρprobe (Ω/sq) of the intermediary transfer belt 6 is measured by the metal probe. A summary of the measuring method is schematically shown in FIG. 3.

In this measurement, in a situation such that a contact property between the intermediary transfer belt 6 and the metal probe is not complete by the influence of the minute unevenness or the like of the surface of the intermediary transfer belt 6, an apparent electric resistance of the intermediary transfer belt 6 is measured based on a current passing through the intermediary transfer belt 6 via physical points of contact between the both members. When the measured resistance is low, improper secondary transfer of a patch-like image described later occurs.

<Resistivity Measured by Sputtering Electrode>

An ion sputtering device ("E-1050", manufactured by Hitachi High-Technologies Corp.) is used, and on the surface of the intermediary transfer belt 6, a metal electrode of Pt having the same pattern as the above-described UR100 probe is provided. A sputtering condition is 20 (mA) in discharge current and 40 (sec) in discharge time. This electrode is wired with a high-resistance meter ("R8340A", manufactured by Advantest Corp.), so that a resistivity ρsputter (Ω/sq) of the intermediary transfer belt 6 is measured by the sputtering electrode. Incidentally, as the opposite plate, the TEFLON surface of the above-described Resitable UFL (MCP-ST03) is similarly used. Under a condition of 250 (V) in applied voltage, 10 (sec) in measurement time and the surface resistance measuring mode, the resistivity ρsputter (Ω/sq) of the intermediary transfer belt 6 by the sputtering electrode is measured. A summary of this measuring method is schematically shown in FIG. 4.

The sputtering electrode is provided so as to cover the minute unevenness of the surface of the intermediary transfer belt 6. That is, in this measurement, in a situation such that the surface property between the intermediary transfer belt 6 surface and the sputtering electrode is completely ensured, a true electric resistance is measured based on the current passing through the material of the intermediary transfer belt 6. When this resistance is high, a vertical stripe of a halftone image described later is generated.

With respect to the same intermediary transfer belt 6, when the resistivities ρprobe and ρsputter are measured, a value of ρsputter is smaller than a value of β probe. Incidentally, during the measurement, a back surface of the intermediary transfer belt 6 is TEFLON surface, and therefore a measured current sufficiently enters not only the neighborhood of the surface of the intermediary transfer belt 6 but also an inside portion of the intermediary transfer belt 6 with respect to a thickness direction, thus passing through the intermediary transfer belt 6. Therefore, both of the measured values can be said that an effective resistivity of the intermediary transfer belt 6 as a whole including not only the resistivity in the neighborhood of the intermediary transfer belt 6 surface but also the resistivity of the intermediary transfer belt 6 with respect to the thickness direction is measured.

7. Image Defect

Image defects generated in the image forming apparatus using the intermediary transfer belt 6 will be described.

<Improper Transfer of Patch-Like Image>

FIG. 5 is a schematic view of a flow of a transfer current (negative current) when a patch-like toner image Tpatch is transferred from the intermediary transfer belt 6 onto the medium P at the secondary transfer nip N2. In the case where the resistance of the intermediary transfer belt 6 is low, the transfer current selectively passes through a patch where the resistance is low. That is, the transfer current flows while bypassing a high-resistance portion Tpatch. As a result a round (bypass) current Iround (negative current) is generated. On the other hand, an amount of a current Ipatch (negative current) which passes through an inside of the patch-like image Tpatch and which contributes to an actual transfer property is decreased. Such a phenomenon causes the improper transfer.

Parts (a), (b) and (c) of FIG. 6 are schematic views of a model simply showing a state in which the round current Iround is gradually changed during passing of the intermediary transfer belt 6 through the secondary transfer nip N2. In these figures, a part (minute portion) of the intermediary transfer belt 6 and the medium P in the secondary transfer nip N2 abut and then are viewed as a current circuit. When the part of the intermediary transfer belt 6 enters the secondary transfer nip N2 ((a) of FIG. 6), the secondary transfer voltage is applied to the current circuit. At this time, the currents Ipatch and Iround are generated. The current Ipatch is a current passing through the inside of the patch-like image Tpatch, and passes through the intermediary transfer belt 6, the toner image Tpatch and the medium P in this order. In this path, an impedance of the toner image Tpatch is larger than impedances of the intermediary transfer belt 6 and the medium P, thus being dominant in a whole system.

On the other hand, Iround is a current passing through a portion outside Tpatch and successively passes through the intermediary transfer belt 6 and the medium P. Path lengths of Ipatch and Iround when the controls pass through the intermediary transfer belt 6 are different from each other. That is, Ipatch passes through the intermediary transfer belt 6 by a length (65 μm) corresponding to a thickness of the intermediary transfer belt 6, and on the other hand, Iround flows by a length (about 10 mm) corresponding to a size of Tpatch, so that the path length of Iround is longer than the path length of the Ipatch. Accordingly, the impedance of the intermediary transfer belt 6 in the path of Iround is larger than the impedance of the medium P, thus being dominant in the whole system.

Here, the impedance of the intermediary transfer belt 6 in the path through which Iround passes can be considered as a synthetic circuit of a resistance component R and a capacitive component C. At the beginning of entrance of the part of the intermediary transfer belt 6 into the secondary transfer nip N2, Iround passes through both of the resistance component R and the capacitive component C. Therefore, when the part of the intermediary transfer belt 6 moves through the secondary transfer nip N2 ((b) of FIG. 6), electric charges −Q and Q are accumulated in the capacitance component C, and then Iround passes through only the resistance component R. At this time, an amount of Iround is decreased.

Incidentally, the part of the intermediary transfer belt 6 and the part of the medium P move while generating a slight "deviation" in positional relationship therebetween during passing through the secondary transfer nip N2. Thus "deviation" is not large such that image defect such as scattering of the toner image or a rubbed image occurs, but is slight. By the "deviation", an electrical contact state between the intermediary transfer belt 6 and the medium P is changed in real time. At this time, to the current circuit shown in FIG. 6, the secondary transfer voltage is applied and not applied repetitively in an intermittent manner. Accordingly, during passing of the part of the intermediary transfer belt 6 in the state of (b) of FIG. 6 through the secondary transfer nip N2, timing when the secondary transfer voltage is not applied arrives. Then, at the timing, the electric charges −Q and Q accumulated in the capacitive component C start electric discharge, so that flow of a relaxation current Irel starts ((c) of FIG. 6).

A time τ required to decrease the electric charges −Q and Q by Irel is represented by the following formula (1) using the resistivity and dielectric constant.

$$\tau = \in \times \rho \quad (1),$$

where $\in (m^{-3} \cdot kg^{-1} \cdot s^4 \cdot A^2)$ is the dielectric constant of the intermediary transfer belt 6 and ρ (Ωcm) is the resistivity of the intermediary transfer belt 6.

In the formula (1), τ (sec) can be considered as a relaxation time of the intermediary transfer belt 6, and is a time required to attenuate the electric charges −Q and Q to 1/e (e: natural logarithm) time thereof.

In the formula (1), ρ is represented by the following formula (2) using the resistivity ρprobe (Ω/sq) of the intermediary transfer belt 6 by the metal probe measurement described above.

$$\rho = K \times \rho probe \quad (2)$$

This formula (2) is an equation for converting ρprobe (Ω/sq) obtained by the measurement into ρ (Ωcm) and can be substituted into the formula (1). When the intermediary transfer belts 6 of various materials shown in this embodiment were studied by the present inventors, it was understood that k=4 was appropriate.

As the resistivity of the intermediary transfer belt 6 used in the formula (2), ρsputter is not used, but ρprobe is used. This is because Iround causing the improper transfer of the patch-like image is a current flowing via a physical point of contact between the intermediary transfer belt 6 and the medium P, and therefore the resistance measured by combining the intermediary transfer belt 6 with the metal probe is suitable for describing this behavior (improper transfer of the patch-like image).

Here, a lower limit of ρprobe for preventing the improper transfer of the patch-like image, i.e., ρprobe_limit, will be described.

When τ obtained by the formula (1) satisfies the following formula (3), the electric discharge of the electric charges −Q and Q is not completed during the passing of the intermediary transfer belt 6 through the secondary transfer nip N2.

$$\tau \geq La/Sitb \quad (3),$$

where La (mm) is a length of N2 with respect to the movement direction of the intermediary transfer belt 6, and Sitb (mm/sec) is a process speed of the intermediary transfer belt 6. That is, when the relaxation time τ of the intermediary transfer belt 6 is longer than the N2 passing time, the state of (c) of FIG. 6 is not generated (or not completed), so that the state of (b) of FIG. 6 is kept for a long time. When the time for which the state of (b) of FIG. 6 is kept becomes long, the amount of Iround is kept at a small value, so that the improper transfer is not generated.

On the other hand, in the case where τ does not satisfy the formula (3), the state of (c) of FIG. 6 is completed within the N2 passing time. Then, the electrical contact state between the intermediary transfer belt 6 and the medium P is restored, so that the state of (a) of FIG. 6 appears again at timing when the secondary transfer voltage is applied to the current circuit. Then the state is gradually changed to the state of (b) of FIG. 6 and then to the state of (c) of FIG. 6. When the value of τ is sufficiently small, after the state of (c) of FIG. 6, the state of (a) of FIG. 6 appears again. With a smaller value of τ, the number of times of repetition of a cycle of the states of (a), (b), (c), (a), . . . of FIG. 6 is increased. In this way, in the case where τ is short and thus does not satisfy the formula (3), the state of (a) of FIG. 6 appears at a high frequency during the passing of the intermediary transfer belt 6 through N2, so that the amount of Iround is kept at a high level. In the image forming apparatus in this embodiment, the constant-current control by the secondary transfer power source 80 is effected, and therefore the amount of Iround becomes large to decrease the amount of Ipatch relatively, so that the improper transfer is generated.

From the above, when ρprobe_limit is written based on the above formulas (1) to (3), the following formula (4) is obtained.

$$\rho probe_limit = La/(k \times Sitb \times \in) \quad (4)$$

<Vertical Stripe of Halftone Image>

FIG. 7 is a schematic view showing a state in which a residual electric charge Qres applied to the intermediary transfer belt 6 at the cleaning nip N3 is moved toward the primary transfer nip N1 (N1 of the image station Sa). In the case where the resistance of the intermediary transfer belt 6 is high, the residual electric charge Qres is conveyed to N1 while being stagnated on the surface of the intermediary transfer belt 6. As a result, when a halftone toner image Tht on the photosensitive drum 1 is primary-transferred at N1, the halftone toner image Tht catches potential non-uniformity due to Qres on the intermediary transfer belt 6, so that a vertical stripe is generated on the halftone image Tht.

Parts (a) and (b) of FIG. 8 are schematic views of a model simply showing a state in which Qres is changed during movement of the intermediary transfer belt 6 from N3 to N1. In these figures, the part (minute portion) of the intermediary transfer belt 6 is cut and viewed as a current circuit. Immediately after the intermediary transfer belt 6 comes out of the cleaning nip N3 ((a) of FIG. 8), the electric charge Qres remains on the intermediary transfer belt 6. This electric charge is provided by the cleaning voltage applied to the cleaning brush 11 at N3. The cleaning brush 11 is constituted by many fibers, and therefore Qres remains in a pattern corresponding to a contact state of the respective fibers with the intermediary transfer belt 6, i.e., in a vertical stripe shape (pattern). Similarly, as in the case of FIG. 6, the intermediary transfer belt 6 can be considered as a synthetic circuit of the resistance component R and the capacitive component C, and Qres is accumulated together with −Qres at a portion C.

Thereafter, when the intermediary transfer belt 6 is moved from N3 to N1 ((b) of FIG. 8), the relaxation current Irel due to the electric discharge of the electric charges Qres and −Qres accumulated in the portion C is generated. Here, a time τ required to decrease the electric charges Qres and −Qres by Irel is represented by the above-described formula (1) using the resistivity and the dielectric constant of the intermediary transfer belt 6.

In this case, ρ in the formula (1) is represented by the following formula (5) using the resistivity ρsputter (Ω/sq) of the intermediary transfer belt 6 by the sputtering electrode measurement described above.

$$\rho = k \times \rho sputter \quad (5)$$

This formula is an equation for converting ρsputter (Ω/sq) into ρ (Ωcm), and k=4.

As the resistivity of the intermediary transfer belt 6 used in the formula (5), ρprobe is not used, but ρsputter is used. This is because Qres causing the vertical stripe of the halftone image is given with the electric discharge in the air by the cleaning brush 11, and the behavior such that Qres purely passes through the materials of the intermediary transfer belt 6 to cause the electric discharge can be suitably defined by a material resistance measured by providing the sputtering electrode.

Here, an upper limit of ρsputter for preventing the vertical stripe of the halftone image, i.e., ρsputter_limit will be described.

When τ obtained by the formula (5) satisfies the following formula (6), the electric discharge of the electric charge Qres is completed during the movement of the intermediary transfer belt 6 from N3 to N1.

$$\tau \leq Lb/Sitb \quad (6),$$

where Lb (mm) is a distance from an exit of N3 to an entrance of N1 (N1a) on a movement surface of the intermediary transfer belt 6, and Sitb (mm/sec) is a process speed of the intermediary transfer belt 6. That is, when the relaxation time τ of the intermediary transfer belt 6 is shorter than a movement time from N3 to N1, the state of (b) of FIG. 8 is completed, so that the vertical stripe is not generated.

On the other hand, in the case where τ does not satisfy the formula (6), the state of (b) of FIG. 8 is not completed during the movement from N3 to N1. Therefore, the state of (a) of FIG. 8 is maintained, so that Qres remains during the entrance into N1. Therefore, the vertical stripe is generated.

From the above, when ρsputter_limit is written based on the above formulas (1), (5) and (6), the following formula (7) is obtained.

$$\rho sputter_limit = Lb/(k \times Sitb \times \in) \quad (7)$$

8. Details of Structure of Intermediary Transfer Belt

Details of the structure of the intermediary transfer belt 6 in this embodiment will be described while being compared with intermediary transfer belts in Comparison constituents.

As the intermediary transfer belt 6 in this embodiment, a belt obtained by the injection stretch blow molding method will be described as an example.

Materials for the intermediary transfer belt 6 in this embodiment includes polyethylene naphthalate as the base resin material, polyetheresteramide resin and sodium perfluorobutanesulfonate as the ion conductive agent, and silica as the fine particles.

On the other hand, intermediary transfer belts 6 in Comparison constituents A, B and C are obtained by using the same material and molding method as those for the intermediary transfer belt 7 having the constitution in this embodiment except that the fine particles are not used. Further, the intermediary transfer belts 6 are different from each other in amount of use of the ion conductive agent, and have higher resistances in the listed order.

Each of the intermediary transfer belts 6 has a thickness of 65 μm.

FIG. 9 is a table showing values of ρprobe, ρsputter and Ra of the intermediary transfer belt 6 in the constitution in this embodiment and the intermediary transfer belts 6 in Comparison constituents A, B and C each in an HH (high temperature/high humidity) environment (30° C. 80% RH) and an LL (low temperature/low humidity) environment (15° C./10% RH). In the table, ρprobe and ρsputter are shown as long values.

Further, in FIG. 9, ΔM and ΔE are amounts defined as follows.

ΔM: difference in log value between ρprobe and ρsputter . . . (definition 1)

ΔE: difference in resistivity between LL environment and HH environment (environmental fluctuation) . . . (definition 2)

Each of the intermediary transfer belts 6 has an ion conductive property (ionic electroconductivity), and is low in resistivity in the HH environment as a first environment and is high in resistivity in the LL environment as a second environment. In general, the intermediary transfer belt 6 having the ion conductive property shows a tendency that the resistivity in the LL environment is higher than the resistivity in the HH environment by 0.5 digit (figure) or more. Incidentally, ΔM is an average value of a difference in log value (difference in digit) between ρprobe and ρsputter in each of the HH environment and the LL environment, and ΔE is an average value of a difference in log value (difference in digit) between ρprobe and ρsputter in each of the HH environment and the LL environment.

FIG. 10 is a table showing values of ρprobe_limit and ρsputter_limit in terms of log values.

For calculation of each of the values, the following parameters are used.

(Image Forming Apparatus)

La=0.8 (mm)

Lb=47 (mm)

Sitb=137 (mm/sec)

(Intermediary Transfer Belt)

k=4

$\in=2.7\times10^{-11}$ ($m^{-3}\cdot kg^{-1}\cdot s^{4}\cdot A^{2}$)

Incidentally, La was obtained by a method such that a dye is applied onto the surface of the secondary transfer roller and then the secondary transfer roller is contacted to and spaced from the intermediary transfer belt 6, and thereafter a width of the dye deposited on the intermediary transfer belt on the intermediary transfer belt 6 is measured.

Further ΔI shown in FIG. 10 is defined as follows.

ΔI: difference in log value between ρprobe_limit and ρsputter_limit (image margin) . . . (definition 3)

Here, the resistances of the intermediary transfer belt 6 in the constitution in this embodiment and the intermediary transfer belts 6 in Comparison constituents A, B and C were shown in FIGS. 11 to 14, respectively.

The resistivities (FIG. 11) of the intermediary transfer belt 6 in the constitution in this embodiment are such that ρprobe is higher than ρprobe_limit in the HH environment, i.e., in an environment in which the value of ρprobe is smallest. Further, in the LL environment, i.e., an environment in which the value of ρprobe is largest, ρsputter is lower than ρsputter_limit. Accordingly, in each of the environments, the improper transfer of the patch-like image and the vertical stripe of the halftone image are compatibly prevented.

On the other hand, with respect to the resistivities of the intermediary transfer belt 6 in Comparison constituent A (FIG. 12), ρprobe is higher than ρprobe_limit in the HH environment, but ρsputter is higher than ρsputter_limit in the LL environment. Accordingly, the vertical stripe is generated in the LL environment.

With respect to the resistivities of the intermediary transfer belt 6 in Comparison constituent B (FIG. 13), ρprobe is lower than ρprobe_limit in the HH environment, and ρsputter is higher than ρsputter_limit in the LL environment. Accordingly, the improper transfer is generated in the HH environment and the vertical stripe is generated in the LL environment.

With respect to the resistivities of the intermediary transfer belt 6 in Comparison constituent C (FIG. 14), ρsputter is higher than ρsputter_limit in the LL environment, but ρprobe is lower than ρprobe_limit in the HH environment. Accordingly, the improper transfer is generated in the HH environment.

The generation of the improper transfer was checked by printing patch-like images of magenta and cyan each having a density of 100% (solid image) on a letter-sized paper (medium) ("HP Multi Purpose 20 lb."). Further, the generation of the vertical stripe was checked by printing a halftone image of magenta and cyan each having the density of 25% on the same medium.

9. Effect

As is apparent from the above description, a resistance condition for compatibly preventing the generations of the improper transfer and the vertical stripe in the environments is as follows.

$$\Delta M \geq ED - \Delta I \quad (8)$$

That is, the resistivity difference (ΔM) between ρprobe and ρsputter is required to be made larger than a value obtained by subtracting the image margin (ΔI) from the resistivity environmental fluctuation (ΔE). When this condition is satisfied, by adjusting the amount of use of the ion conductive agent, it is possible to set the resistivities of the intermediary transfer belt 6 so that ρprobe is higher than ρprobe_limit and ρsputter is lower than ρsputter_limit.

With respect to the intermediary transfer belt 6 in the constitution of this embodiment, by the effect of the fine particles, a large ΔM is ensured by forming a minute unevenness having Ra=10 (nm) at the surface of the intermediary transfer belt 6, and is not less than a value of (ΔE−ΔI). Accordingly, the improper transfer and the vertical stripe are compatibly suppressed.

On the other hand, in the intermediary transfer belts 6 in Comparison constituents A, B and C, the fine particles are not used, and thus there is no minute unevenness at the surfaces of the intermediary transfer belts 6, so that Ra is 0.5 (nm) and thus ΔM is small. As a result, ΔM is smaller than the value of (ΔE−ΔI). Accordingly, even when the amount of use of the ion conductive is adjusted, either one of the improper transfer and the vertical stripe is generated.

With respect to the intermediary transfer belts 6 of various materials shown in this embodiment, when the present inventors studied, as the surface roughness of the intermediary transfer belt 6 for satisfying the above-described formula (8), it was found that the following range was appropriate.

$$3\ (\mathrm{nm}) \leq Ra \leq 30\ (\mathrm{nm})$$

When Ra<3 (nm), ΔM does not become a sufficient value, so that the improper transfer and the vertical stripe cannot be compatibly suppressed. On the other hand, when Ra>30 (nm), a close contact property between the intermediary transfer belt 6 and the medium P in the secondary transfer nip N2 is impaired, so that a transfer efficiency becomes worse.

Here, when the above formula (8) is rewritten by using the formulas (3) and (7) and the definition 3 described above to effect generalization, the following formula (8') is obtained.

$$\Delta M \geq \Delta E - \mathrm{Log}(Lb/La). \quad (8')$$

This formula (8') does not contain k and ∈ and is satisfied by only using the parameters ΔM and ΔE of the intermediary transfer belt 6 and the parameters La and Lb of the apparatus constitution.

As described above, the intermediary transfer belt 6 in this embodiment is provided with a large resistivity difference between ρprobe and ρsputter by forming the minute unevenness at the surface thereof. That is, in each of the environments, an apparent resistance with respect to the temperature is kept at a high value while suppressing a material resistance at a low level. Further, the resistivity difference (ΔM) between ρprobe and ρsputter is made larger than the value obtained by subtracting the image margin (ΔI) from the resistivity environmental fluctuation (ΔE). Accordingly, the improper transfer and the vertical stripe are suppressed compatibly.

Incidentally, in this embodiment, as a condition for remarkably representing the environment fluctuation, specific condition values in the HH environment and the LL environment are set at 30° C./80% RH and 15° C./80% RH, respectively, but these values are merely examples. The HH environment, i.e., a typical condition value as the high temperature/high humidity in which the value of ρprobe becomes small varies depending on the specification, a condition of use and the like in some cases, and is appropriately set depending on a situation. This is true for also the LL environment, i.e., a typical condition value as the low temperature/low humidity environment in which the value of ρsputter becomes large. That is, if these values are numerical values capable of remarkably representing the environment fluctuation, the values are not limited to those described above.

Embodiment 2

Next, Embodiment 2 of the present invention will be described. FIG. 15 is a schematic sectional view showing a general structure of an image forming apparatus 100 in this embodiment. Basic constitution and operation of the image forming apparatus 100 in this embodiment are the same as those in the image forming apparatus 100 in Embodiment 1, but a cleaning mechanism of the secondary transfer residual toner is different from that in Embodiment 1. Items which are not particularly described in the following are similar to those in Embodiment 1, and will be omitted from description.

The intermediary transfer belt 6 in the image forming apparatus 100 in this embodiment is the same as the intermediary transfer belt 6 described in Embodiment 1. In a position opposing the driving roller 61 via the intermediary transfer belt 6, a cleaner 14 is provided. The transfer residual toner remaining on the intermediary transfer belt 6 without being transferred onto the medium P in the secondary transfer step is removed from the intermediary transfer belt 6 by the cleaner 14 and is collected in the cleaner 14.

Image defects capable of being generated in the image forming apparatus in this embodiment will be described. A condition of the generation of the improper transfer of the patch-like image is the same as that in the case of Embodiment 1. On the other hand, in the image forming apparatus in this embodiment, in place of the vertical stripe of the halftone image described in Embodiment 1, there is a possibility that graininess of the halftone image is generated.

Immediately after the part (minute portion) of the intermediary transfer belt 6 comes out of the secondary transfer nip N2, the electric charge Qres remains on the part of the intermediary transfer belt 6. This electric charge is given by the secondary transfer voltage applied to the secondary transfer roller 8 at N2. The secondary transfer roller 8 is constituted by the formed elastic member, and therefore Qres remains on the intermediary transfer belt 6 in a pattern corresponding to the contact state of form cells with the intermediary transfer belt 6, i.e., a mottled shape (pattern). This constitutes the cause which generates the graininess at the primary transfer portion.

An upper limit of ρsputter for suppressing the graininess of the halftone image in the image forming apparatus in this embodiment, i.e., ρsputter_limit is obtained from the following formula (9).

$$\rho\mathrm{sputter_limit} = Lc/(k \times Sitb \times \in) \quad (9)$$

Lc (mm) represents a distance from an exit of N2 to an entrance of N1 on the movement surface of the intermediary transfer belt 6; other parameters are the same as those described above.

FIG. 16 is a table showing values of ρprobe_limit and ρsputter_limit in terms of log value. For calculating the values, Lc=200 (mm) as the parameter of the image forming apparatus in this embodiment was used.

The resistivities of the intermediary transfer belt 6 in the constitution of this embodiment were shown in FIG. 17. The resistivities of the intermediary transfer belt 6 in the constitution of this embodiment are such that ρprobe is higher than ρprobe_limit in the HH environment and ρsputter is lower than ρsputter_limit in the LL environment. Accordingly, the improper transfer of the patch-like image and the graininess of the halftone image are compatibly prevented in the respective environments.

When the resistance condition of the intermediary transfer belt 6 in this embodiment is represented by using only the parameters ΔM and ΔE of the intermediary transfer belt 6 and the parameters La and Lc of the apparatus constitution, the following formula (10) is satisfied.

$$\Delta M \geq \Delta E - \log(Lc/La) \quad (10)$$

As described above, also in the image forming apparatus in which a portion where the intermediary transfer belt 6 finally receives the electric charge in front of the primary transfer portion is the secondary transfer portion, the generation of the image defect can be suitably suppressed. That is, by providing the intermediary transfer belt 6 with a large resistivity difference (ΔM) between ρprobe and ρsputter, it is possible to compatibly suppress the improper transfer and the graininess.

The present invention is described based on specific embodiments, but is not limited to Embodiments described above.

For example, the constitution of the present invention is suitably applied to not only the intermediary transfer belt 6 of a single layer consisting of the base material, but also an intermediary transfer belt **6*b* having a layer structure consisting of a plurality of layers. That is, by using the above-described intermediary transfer belt 6 as the base material and then by subjecting the intermediary transfer belt 6 to coating such as a dip coating, a spray coating, a roll coating or a spin coating, a coat layer can be provided. As a base material for the coat layer, it is possible to use a curable resin material such as melamine resin, urethane resin, alkyd resin or acrylic resin. Also by adding the fine particles into this coat layer, the minute unevenness can be formed at the surface of the intermediary transfer belt 6. The thus-obtained intermediary transfer belt 6 is schematically shown in FIG. 18. Part (a) of FIG. 18 is a schematic sectional view of the intermediary transfer belt 6, and (b) of FIG. 18 is a schematic front view of the intermediary transfer belt 6. As shown in these figures, by disposing the added fine particles in the coat layer material, the surface of the intermediary transfer belt 6** is provided with the minute unevenness. Also in the constitution of this embodiment, it is possible to increase the difference (ΔM) between ρprobe and ρsputter, so that the constitution of the present invention can be suitably applied. Incidentally, as the coat layer, it is possible to use both of a material containing the ion conductive agent and a material which does not contain the ion conductive agent. If the coat layer contains the ion conductive agent, the base material is not necessarily required to contain the ion conductive agent.

Further, it is also possible to use the intermediary transfer belt 6 including a layer containing the ion conductive agent, irrespective of the base material and the coat layer. Examples of the ion conductive agent may include a carbon-based filler such as carbon black, PAN-based carbon fiber or pulverized graphite, a metal-based filler such as silver, nickel, copper, aluminum, stainless steel or iron, and a metal oxide-based filler such as tin oxide doped with antimony, indium oxide doped with tin or zinc oxide doped with aluminum. Even in such a constitution, if a basic electroconductivity of the intermediary transfer belt 6 is controlled by the ion conductive agent and thus the intermediary transfer belt 6 is small in variation of the resistance value and applied voltage dependency and causes the environmental fluctuation in resistance value, the constitution of the present invention can be suitably applied.

Incidentally, as the method of providing the large difference (ΔM) between ρprobe and ρsputter, it is possible to employ a method other than the method of adding the fine particles to the intermediary transfer belt 6. For example, it is possible to use a method of physically rubbing the surface of the intermediary transfer belt 6 and a method of manufacturing the intermediary transfer belt 6 by transferring a pattern of a metal mold surface having an uneven shape onto the surface of the intermediary transfer belt 6.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

an image bearing member for bearing a toner image;

a rotationally movable intermediary transfer belt onto which the toner image is to be primary-transferred from said image bearing member at a primary transfer portion where said intermediary transfer belt contacts said image bearing member, wherein said intermediary transfer belt has electroconductivity by containing an ion conductive agent;

a secondary transfer member for secondary-transferring the toner image from said intermediary transfer belt onto a transfer material at a secondary transfer portion where said intermediary transfer belt contacts the transfer material; and a charging device for electrically charging said intermediary transfer belt or a toner on said intermediary transfer belt at a charging portion positioned downstream of the secondary transfer portion and upstream of the primary transfer portion with respect to a movement direction of said intermediary transfer member, wherein when a difference in logarithmic value between resistivity of said intermediary transfer belt measured by using a metal probe and resistivity of said intermediary transfer belt measured by using a sputtering electrode is ΔM, a difference in logarithmic value between resistivity of said intermediary transfer belt in a first environment and resistivity of said intermediary transfer belt in a second environment higher than the first environment in temperature or humidity is ΔE, a length of the secondary transfer portion with respect to the movement direction of said intermediary transfer belt is La, and a distance from the charging portion to the primary transfer portion with respect to the movement direction is Lb, the following relationship is satisfied:

$$\Delta M \geq \Delta E - \log(Lb/La).$$

2. An image forming apparatus according to claim 1, wherein a surface shape of said intermediary transfer belt is formed by adding particles.

3. An image forming apparatus according to claim 2, wherein said intermediary transfer belt has an average in-plane roughness Ra, measured at a surface thereof by a scanning probe microscope, satisfying:

$$3\ \text{nm} \leq Ra \leq 30\ \text{nm}.$$

4. An image forming apparatus according to claim 1, wherein said charging device is supplied with a voltage of an opposite polarity to a normal charge polarity of the toner to electrically charge the toner on said intermediary transfer belt to the opposite polarity.

5. An image forming apparatus according to claim 1, wherein the resistivity measured by using the metal probe is a surface resistivity (Ω/sq) measured in a state in which a metal-made probe as a measuring probe is contacted to said intermediary transfer belt.

6. An image forming apparatus according to claim 5, wherein the resistivity measured by using the sputtering electrode is a surface resistivity (Ω/sq) measured by providing a metal electrode, on a surface of said intermediary transfer belt, having a same pattern as a pattern of the measuring probe.

7. An image forming apparatus according to claim 1, wherein the first environment is 15° C. and 10% RH.

8. An image forming apparatus according to claim 7, wherein the second environment is 30° C. and 80% RH.

9. An image forming apparatus comprising:

an image bearing member for bearing a toner image;

a rotationally movable intermediary transfer belt onto which the toner image is to be primary-transferred from said image bearing member at a primary transfer portion where said intermediary transfer belt contacts said image bearing member, wherein said intermediary transfer belt has electroconductivity by containing an ion conductive agent; and a secondary transfer member for secondary-transferring the toner image from said intermediary transfer belt onto a transfer material at a secondary transfer portion where said intermediary transfer belt contacts the transfer material, wherein when a difference in logarithmic value between resistivity of said intermediary transfer belt measured by using a metal probe and resistivity of said intermediary transfer belt measured by using a sputtering electrode is ΔM, a difference in logarithmic value between resistivity of said intermediary transfer belt in a first environment and resistivity of said intermediary transfer belt in a second environment higher than the first environment in temperature or humidity is ΔE, a length of the secondary transfer portion with respect to the movement direction of said intermediary transfer belt is La, and a distance from the secondary transfer portion to the primary transfer portion with respect to the movement direction is Lc, the following relationship is satisfied:

$$\Delta M > \Delta E - \log(Lc/La).$$

10. An image forming apparatus according to claim 9, wherein a surface shape of said intermediary transfer belt is formed by adding particles.

11. An image forming apparatus according to claim 10, wherein said intermediary transfer belt has an average in-plane roughness Ra, measured at a surface thereof by a scanning probe microscope, satisfying:

$$3\ \text{nm} \leq Ra \leq 30\ \text{nm}.$$

12. An image forming apparatus according to claim 9, wherein the resistivity measured by using the metal probe is a surface resistivity (Ω/sq) measured in a state in which a metal-made probe as a measuring probe is contacted to said intermediary transfer belt.

13. An image forming apparatus according to claim 12, wherein the resistivity measured by using the sputtering electrode is a surface resistivity (Ω/sq) measured by providing a metal electrode, on a surface of said intermediary transfer belt, having a same pattern as a pattern of the measuring probe.

14. An image forming apparatus according to claim 9, wherein the first environment is 15° C. and 10% RH.

15. An image forming apparatus according to claim 9, wherein the second environment is 30° C. and 80% RH.

16. An image forming apparatus according to claim 9, wherein said image bearing member comprises a plurality of image bearing members, and the primary transfer portion is formed by said intermediary transfer belt and one of the image bearing members disposed most upstream with respect to the movement direction of said intermediary transfer belt.

* * * * *